United States Patent [19]

Ghosh et al.

[11] 4,180,425

[45] Dec. 25, 1979

[54] GELATINE EXPLOSIVE COMPOSITIONS

[75] Inventors: Bidhan C. Ghosh; Gopal M. Chopra; Soumendra N. Sen, all of Bihar, India

[73] Assignee: Indian Explosives Limited, Bengal, India

[21] Appl. No.: 926,610

[22] Filed: Jul. 21, 1978

[51] Int. Cl.[2] ..... C06B 25/30

[52] U.S. Cl. ..... 149/95; 149/21; 149/48; 149/52; 149/53; 149/101; 149/103; 149/105

[58] Field of Search ..... 149/101, 21, 52, 48, 149/53, 103, 105, 95

[56] References Cited

U.S. PATENT DOCUMENTS 2,124,201 7/1938 Lewis et al. ..... 149/53 X

*Primary Examiner*—Stephen J. Lechert, Jr.

*Attorney, Agent, or Firm*—Ladas, Parry, Von Gehr, Goldsmith & Deschamps

[57] ABSTRACT

A new gelatine explosive composition is disclosed comprising mixtures of nitric esters, ortho-nitro-toluene, blasting soluble nitrocotton, oxidizing salts, fuels and at least one dispersing agent. Said gelatine explosive composition is markedly reduced in the quantities of liquid nitric esters and blasting soluble nitrocotton content.

16 Claims, No Drawings

GELATINE EXPLOSIVE COMPOSITIONS

This invention relates to new gelatine explosive compositions (both Permitteds and Non-Permitteds) and a method for producing the same. In the said compositions the content of hazardous liquid sensitiser (nitric esters) and the BSNC (Blasting Soluble Nitro Cotton) content which are the most expensive ingredients in the explosive composition have been substantially reduced from the normal level of about 28 to 30 percent and 1.2% to 21 to 23 percent and 0.6% w/w respectively. This is achieved by the use of a very small quantity of dispersing/wetting agent with or without the use of Tamrind Seed Flour as a water proofing agent.

This invention is a major breakthrough in design and manufacture of explosives based on nitroglycerine and/or ethylene glycol dinitrate (referred subsequently as NG/EGDN). It is known in the art that the usage of nitroglycerine which is quite hazardous in handling, has been progressively reduced by the addition of oxidising salts such as Ammonium nitrate, Sodium nitrate etc. However, beyond certain limit it was difficult to bring down the nitroglycerine content any further as the gelatinous consistency and extrudability of the explosive compositions were affected adversely. Attempts were, therefore, made in many countries to use plasticity promoting agents both synthetic as well as natural products with the basic purpose of maintaining gelatinous consistency with reduced Nitroglycerine content. Some success was achieved with the use of plasticity promoting agents, such as those based on the condensation products of alkylene oxide with long chain fatty acids, fatty amines, fatty amides, long chain fatty alcohols, sulphated sodium salt etc. as described in Indian Pat. No. 122343.

Such compositions were, however, found to have the following major drawbacks:

(a) These gelatinous compositions were incapable of extrusion in small diameter down to 22 mm in the conventional cartridging machines.

(b) The sensitivity was adversely affected on storage within a period of six to nine months.

(c) To facilitate extrusion and make the stuff more plastic substantial quantity of wheat flour (a valuable food stuff) had to be added.

The compositions of the present invention, containing a small amount of dispersing/wetting agent have not only helped to overcome all the disadvantages mentioned above but have also imparted marked improvements in a number of critical and special properties of the explosives and are superior in explosive characteristics and performance. The said compositions are much safer in handling compared to the other compositions without a dispersing agent.

The compositions of the present invention are gelatinous in character with medium plasticity and have good rheology (flow property). The said compositions are extrudable in standard cartridging machines (such as the Dupont Machine) with varying cartridge diameter of about 22 mm and upwards, all being cartridged in cylindrical paper shells.

The gelatinized explosive compositions according to the invention comprising much less liquid nitric ester as a result of the incorporation of dispersing/wetting agent have the following advantages:

(i) Substantially reduced impact and friction sensitivity. These were measured following the standard ICI method.

(ii) Substantially improved sensitivity to initiation especially after long storage.

(iii) Higher velocity of detonation as determined by the Dautriche method.

(iv) Higher Ardeer Double Cartridge test (ADC), all above 10 cms. after prolonged storage.

(v) Improved "water resistance" characteristics when tested according to the ISI method.

(vi) Significant improvement in fume characteristic (10–30% less of toxic gases) after detonation, compared to the existing compositions having a higher amount of liquid nitric ester and no dispersing agent.

(vii) Gelatine explosive compositions developed with dispersing agent have slightly reduced density thereby facilitating superior fragmentation in many applications.

(viii) The compositions of this invention are very much less prone to the segregation of liquid nitric ester from nitrocotton, a highly hazardous phenomenon called "exudation."

(ix) The nitroglycerine and BSNC (Blasting Soluble Nitrocotton) are the most expensive ingredients of the compositions. Reduced usage of these renders the compositions more economical and consequent cost reduction in the manufacture of explosives.

(x) Substantial reduction in the usage of nitroglycerine renders the manufacture of explosives more safe.

It is known to use tamarind seed flour (TSF) as a water proofing agent in explosive composition. The use of these water proofing agents such as TSF is optional. Water proofing agents such as TSF are generally used in the proportion of up to 1% w/w. However, now it has additionally been found that by increasing the percentage of TSF, in addition to its water proofing properties, its presence in explosive compositions of this invention brings about still better dispersion of NG/EGDN in the explosive composition thereby enabling further reduction in the quantity of NG/EGDN and BSNC. It has been found that increasing the percentage of TSF up to 3% achieves optimum results.

According to this invention there is provided an improved gelatine explosive composition with a marked reduction in the quantities of liquid nitric esters and blasting soluble nitrocotton content, comprising essentially mixtures of nitric esters like nitroglycerine and/or nitro glycol, ortho nitro toluene, blasting soluble nitro cotton, oxidising salts such as ammonium nitrate, fuels such as wood meal and/or waxed wood meal characterized in that the said gelatine explosive composition contains at least one dispersing agent such as herein described and, if desired, a water proofing agent such as tamarind seed flour or guar gum.

This invention also provides a method of producing a gelatine explosive composition as defined above comprising the steps of adding at least one dispersing agent to the mixture of liquid nitric esters and ortho nitro toluene, adding the resulting mixtures to blasting soluble nitro cotton in conventional mixer for the formation of a gel and subsequently adding the remaining ingredients, namely oxidizing salts, fuels and, where desired, the water proofing agent such as tamarind seed flour or guar gum to form a homogenous mixture.

In the compositions and the method of producing the same, according to this invention, the following dispersing agents which are well-known are utilized:

Amide of a fatty acid e.g. "Cirrasol TW;" Condensation product of formaldehyde and sodium naphthalene sulphonate, e.g. "Dispersol T;" sodium salt of Sulphated Oleyl/Cetyl alcohol mixture, e.g. "Lissapol D" paste; Condensation product of polyethylene glycol, e.g. "Cirrasol FPI;" Highly sulphonated methyl ester of a fatty alcohol, e.g. "Calsolene oil HSI;" Mixture of a fatty acid amine and sulphated alcohol, e.g. "Cirrasol XL;" an Alkyl aryl sulphonated sodium salt, e.g. "Lissapol CW;" Soya oil fatty amine, e.g. "Soya amine," "Armeen S;" a Triethanol amine fatty acid, e.g. "Whitcol WS" and Monoethylene glycol. These dispersing agents were tried at proportions varying between 0.1 to 1.0% w/w at various stages of the mixing. Preferably, 0.1 to 0.4% w/w of the said dispersing agent is used. These chemicals are mixed with nitro-glycerine/nitroglycol and ortho-nitrotoluene before the other ingredients are mixed.

By using about 3% w/w Tamarind Seed Flour in conjunction with a small quantity of dispersing/wetting agents in the invented composition, the liquid nitric ester content was reduced further by about 3 to 4% w/w with a proportionate reduction in BSNC. This reduced the cost of the explosives further, maintained the softness of the cartridge on long storage and increased the storage sensitivity. Minor modifications in the percentage of the explosives ingredients were carried out to main the uniformity in other properties. The compositions having Tamarind Seed Flour had the extrudability similar to earlier invented compositions and could be cartridged down to 22 mm diameter in cylindrical form for example, in the Dupont cartridging machine. The other explosives characteristics were not affected even after long storage.

The dispersion efficiency of the dispersing/wetting agents used in non-aqueous medium was determined by a technique evolved in the laboratory.

(i) The ingredients to be dispersed were made from a mixture of ammonium nitrate fine and Ammonium nitrate coarse in the proportion of 2:1.

(ii) One standard composition was selected and its nitroglycerine and nitrocotton jelly was made in the Starret Mixer to which the required quantity of ammonium nitrate mixture was slowly added and mixed till a homogeneous consistency was obtained. This consistency was measured quantitatively.

(iii) To a similar gel (nitroglycerine and nitrocotton jelly) containing a small quantity of dispersing agent, similar mixture of ammonium nitrate was added and the addition continued till an equivalent stuff consistency was reached. This consistency also was measured and compared against the stuff having no dispersing agent.

It was found that the compositions having certain dispersing agents had dispersing power in the dispersion of ammonium nitrate in reduced quantity of nitroglycerine jelly and particularly Cirrasol TW had the highest dispersing power. 0.4% of the said dispersing agent increased the dispersion of ammonium nitrate by about 50%. The said technique was also adopted in the plant for the addition of dispersing agents.

The advantage of following the said technique is to increase the dispersing efficiency of the reduced amount of nitroglycerine and nitrocotton gel. The amount of liquid nitric ester which is normally about 30% w/w was substantially reduced to 21.5% w/w by the use of 0.30% w/w of "Cirrasol TW". Taking into account the safety aspect in handling nitroglycerine, "Cirrasol TW" was mixed along with nitroglycerine and nitroglycol, and ortho-nitro toluene mixture (wherever required as per composition) in the nitroglycerine store house itself and brought to the mixing house for mixing with other solid ingredients. As mentioned above the dispersing/wetting agent used, to facilitate the dispersion of solid ingredients in the reduced amount of gelatinised nitric ester, was selected from a simple amide of a fatty acid soluble in water. There may be a need for modifying the dispersing agents to make them compatible with nitric esters mixture. Thus for e.g. "Cirrasol TW," which was never used in the explosive industry before, was specially modified by adjusting the pH and alkalinity so as to make it compatible with Nitric esters mixture (NG/EGDN). The said modification helped "Cirrasol TW" to be suitable for the explosive industry.

The following Tables and Examples serve merely to illustrate the invention without being limited thereto.

TABLE 1

EXPLOSIVE COMPOSITIONS WITH DISPERSING AGENT

| Example Nos. | Ex-1 | Ex-2 | Ex-3 | Ex-4 | Ex-5 | Ex-6 |
|---|---|---|---|---|---|---|
| INGREDIENTS | | | | | | |
| Nitroglycerine/ Nitroglycol | 22.5 | 23.0 | 23.5 | 20.0 | 22.0 | 21.5 |
| Nitrocotton (Dry wt) | 0.6 | 0.6 | 0.7 | 0.6 | 0.6 | 0.6 |
| Ortho-nitrotoluene | 1.0 | 1.0 | 1.5 | 4.0 | — | — |
| Ammonium nitrate | 55.3 | 65.0 | 68.5 | 65.0 | 47.5 | 35.0 |
| Woodmeal | 1.0 | 0.5 | 0.8 | 0.5 | 1.0 | 0.3 |
| Tamarind seed flour | 1.0 | 1.0 | 1.0 | 1.0 | 0.5 | — |
| Barytes | 8.0 | 6.0 | 2.0 | 6.0 | 6.5 | 10.0 |
| Waxed woodmeal | 1.0 | 1.3 | 1.4 | 1.3 | 1.0 | 0.7 |
| China clay | 1.0 | 1.0 | — | 1.0 | 1.0 | — |
| Guar gum | — | — | — | — | — | 0.5 |
| Rosin | 0.3 | 0.3 | 0.3 | 0.3 | 0.3 | 0.3 |
| Sodium chloride | 8.0 | — | — | — | 19.3 | 30.8 |
| Cirrasol TW | 0.3 | 0.3 | 0.3 | 0.3 | 0.3 | 0.3 |

TABLE 2

TYPICAL EXPLOSIVE PROPERTIES AND CHARACTERISTICS OF COMPOSITIONS WITH DISPERSING AGENT

| Example No. | 1 | 2 | 3 | 4 | 5 | 6 |
|---|---|---|---|---|---|---|
| 1. Density gm/cc | 1.42 | 1.40 | 1.33 | 1.42 | 1.50 | 1.60 |
| 2. Ballistic mortor % EG | 67.2 | 78.7 | 83.7 | 78.7 | 58.4 | 42.8 |
| 3. Water resistance (hrs) | 40 | 40 | 40 | 40 | 40 | 40 |
| 4. Impact sensitivity in cms (500g hammer) | >25 | >20 | 25–30 | >20 | >20 | >20 |
| 5. Friction sensitivity 1 Kg in cms | >160 | 100–110 | >100 | >150 | >150 | >160 |
| 6. Explosive firing characteristics | | | | | | |
| 1 month ADC in cm | >10 | >10 | >10 | >10 | >10 | >10 |
| 1 month VOD km/sec | 2.2 | 2.3 | 2.4 | 2.5 | 2.6 | 2.1 |
| 3 months ADC in cm | >10 | >10 | >10 | >10 | 10 | 10 |

TABLE 2-continued

TYPICAL EXPLOSIVE PROPERTIES AND CHARACTERISTICS OF COMPOSITIONS WITH DISPERSING AGENT

| Example No. | 1 | 2 | 3 | 4 | 5 | 6 |
|---|---|---|---|---|---|---|
| 3 months VOD in km/sec | 2.1 | 2.0 | 2.4 | 2.2 | 2.4 | 1.9 |
| 6 months ADC in cm | 10 | >10 | >10 | 10 | 5 | 5 |
| 6 months VOD km/sec | 2.1 | 2.0 | 2.3 | 2.2 | 2.2 | 1.7 |
| 9 months ADC in cm | 10 | >10 | >10 | 5 | 10 | 5 |
| 9 months VOD in km/sec | 1.8 | 2.0 | 2.3 | 1.9 | 2.3 | 1.5 |
| 7. Post-detonation toxic fumes: | | | | | | |
| (a) Carbon monoxide in lits/kg of explosive in standard wrapper | 35.0 | 27.0 | 27.0 | 29.0 | 16.3 | 19.1 |
| b) Oxides of nitrogen in lits/kg of explosive in standard wrapper | 11.0 | 7.0 | 8.0 | 7.0 | 6.4 | 5.7 |
| 8. Ambient storage exudation | NIL FOR TWELVE MONTHS | | | | | |

TABLE 3

SIMILAR EXPLOSIVE COMPOSITIONS WITHOUT DISPERSING AGENT

| Example Nos. | 1 | 2 | 3 | 4 | 5 | 6 |
|---|---|---|---|---|---|---|
| INGREDIENTS | | | | | | |
| Nitroglycerine/ Nitroglycol | 26.5 | 27.0 | 30.5 | 24.5 | 30.0 | 30.0 |
| Nitrocotton (Dry wt) | 0.8 | 0.8 | 1.2 | 0.9 | 0.7 | 0.7 |
| Ortho-nitro toluene | 1.5 | 1.5 | 1.5 | 4.5 | — | — |
| Ammonium nitrate | 49.5 | 59.4 | 62.0 | 60.0 | 37.4 | 33.3 |
| Woodmeal | 2.0 | 2.5 | 3.0 | 1.0 | 1.0 | 1.0 |
| Tamarind seed flour | — | 1.0 | 1.0 | — | 1.0 | 1.0 |
| Barytes | 6.0 | 7.5 | — | — | — | 0.5 |
| Waxed woodmeal | 1.0 | — | 0.5 | 1.0 | 1.0 | 1.0 |
| China clay | — | — | — | — | — | — |
| Guar gum | — | — | — | — | — | — |
| Rosin | 0.3 | 0.3 | 0.3 | 0.3 | 0.3 | 0.3 |
| Sodium chloride | 12.4 | — | — | 7.8 | 28.6 | 32.2 |

TABLE 5-continued

TYPICAL EXPLOSIVE COMPOSITIONS WITH PLASTICITY PROMOTING AGENT & WHEAT FLOUR

| Ingredients | Ex-1 | Ex-2 | Ex-3 | Ex-4 |
|---|---|---|---|---|
| Ammonium nitrate coarse | — | — | — | 14.7 |
| Nitroglycerine | 17.5 | 17.5 | 17.5 | 17.5 |
| Nitrocotton (Dry wt) | 0.6 | 0.6 | 0.6 | 0.6 |
| Ortho-nitro toluene | — | 0.5 | 0.5 | — |
| Woodmeal | — | — | — | — |
| Wheat flour | 7.0 | 7.5 | 7.5 | 7.0 |
| Guar gum | — | — | — | — |
| Pregelled starch | 0.5 | — | — | 0.5 |
| Sodium nitrate | — | — | — | — |
| China clay | — | — | — | — |
| Diammonium Phosphate | — | — | — | — |
| Plasticity promoting agent | 1.0 | *1.0 | *0.7 | *1.0 |

*Sulphate of Nenyl Phenol Sodium salt condensed with 5 moles of Ethylene oxide. Example no. 1 contains sulphate of tributylphenol sodium salt with 3 moles of Ethylene oxide.

TABLE 4

TYPICAL EXPLOSIVE PROPERTIES & CHARACTERISTICS OF COMPOSITIONS WITHOUT DISPERSING AGENT

| Example Nos. | 1 | 2 | 3 | 4 | 5 | 6 |
|---|---|---|---|---|---|---|
| 1. Density gm/cc | 1.45 | 1.42 | 1.40 | 1.45 | 1.55 | 1.65 |
| 2. Ballistic mortor % EG | 66.9 | 78.0 | 83.7 | 76.0 | 54.0 | 42.9 |
| 3. Water resistance (hrs) | 15 | 19 | 20 | 20 | 20 | 20 |
| 4. Impact sensitivity in cms (500 g hammer) | 15–20 | 15–20 | 10–15 | 15–20 | 10–15 | 5–10 |
| 5. Friction sensitivity 1 kg in cms | >150 | 50–60 | 60–70 | 100–110 | 100–110 | >150 |
| 6. Explosive firing characteristics: | | | | | | |
| 1 month ADC in cm | 10 | 10 | 10 | 10 | >10 | 5 |
| 1 month VOD km/sec | 2.1 | 2.0 | 1.9 | 2.2 | 2.6 | 2.3 |
| 3 months ADC in cm | 10.0 | 10 | 10 | 10 | 5 | 5 |
| 3 months VOD km/sec | 1.7 | months 1.8 | 2.0 | 2.2 | 1.6 | |
| 6 months ADC in cm | 5 | 5 | 10 | 5 | *CF | 2 |
| 6 months VOD km/sec | 1.7 | 1.8 | 1.5 | 1.6 | CF | 1.6 |
| 9 months ADC in cm | 2 | 2 | 5 | 2 | CF | CF |
| 9 months VOD kg/sec | 1.5 | 1.5 | 1.2 | 1.1 | CF | CF |
| 7. Post Detonation Fumes | | | | | | |
| a) Carbon monoxide in lits/kg of explosive in standard wrapper | 42.5 | 35.2 | 37.2 | 39.5 | 23.8 | 29.8 |
| b) Oxides of nitrogen in lits/kg of explosive in standard wrapper | 12.6 | 8.4 | 9.8 | 9.6 | 9.2 | 10.4 |
| 8. Ambient storage exudation | Sweating to trace exudation after six to nine months | | | | | |

*CF means cartridge failed to detonate.

TABLE 5

TYPICAL EXPLOSIVE COMPOSITIONS WITH PLASTICITY PROMOTING AGENT & WHEAT FLOUR

| Ingredients | Ex-1 | Ex-2 | Ex-3 | Ex-4 |
|---|---|---|---|---|
| Ammonium nitrate fine | 73.4 | 72.9 | 73.2 | 58.7 |

TABLE 6

Typical Explosive Properties and Characteristics with Elasticity Promoting Agent and Wheat Flour

| Example No. | Ex-1 | Ex-2 | Ex-3 | Ex-4 |
|---|---|---|---|---|
| Density (gm/cc) | 1.40 | 1.36 | — | 1.43 |

TABLE 6-continued

Typical Explosive Properties and Characteristics with Elasticity Promoting Agent and Wheat Flour

| Example No. | Ex-1 | Ex-2 | Ex-3 | Ex-4 |
|---|---|---|---|---|
| Ballistic Mortor % BG | 78 | 76 | — | — |
| Water resistance (Hours) | — | 24 | — | — |
| Pressure Exudation percentage | — | 0.2 | 0.2 | — |
| Explosives Characteristics | | | | |
| 1 months ADC in cm | 1.5 | 5 | 4 | 7.5 |
| 1 months VOD km/sec. | 2.5 | 2.9 | 3.0 | 4.0 |
| 2 months ADC in cm | 0.5 | 3.5 | 3.5 | 5.5 |
| 2 months VOD km/sec. | 2.2 | 2.4 | 2.8 | 3.3 |
| 4 months ADC in cm | 0.5 | 3.5 | 3.5 | 4.5 |
| 4 months VOD km/sec. | 2.1 | 2.5 | 2.5 | 3.4 |
| 9 months ADC in cm | 0.5 | — | 2.5 | — |
| 9 months VOD km/sec. | 2.1 | — | 2.7 | — |

TABLE - 7

Explosive Compositions with Dispersing Agent and Increased Tamarind Seed Flour

| Example Nos. | Ex - 1 | Ex - 2 | Ex - 3 | Ex - 4 |
|---|---|---|---|---|
| INGREDIENTS: | | | | |
| Nitrogylcerine/Nitroglycol | 19.5 | 19.0 | 21.5 | 18.0 |
| Nitrocotton (Dry wt) | 0.5 | 0.5 | 0.6 | 0.5 |
| Ortho-nitro-toluene | 1.0 | 1.0 | — | 4.0 |
| Ammonium nitrate | 58.2 | 69.1 | 71.3 | 67.4 |
| Woodmeal | 0.2 | 0.3 | 0.2 | 0.2 |
| Tamarind seed flour | 3.0 | 3.0 | 3.0 | 3.0 |
| Barytes | 4.0 | 6.5 | 2.0 | 6.0 |
| Waxed woodmeal | 0.3 | — | 0.8 | 0.3 |
| China clay | 1.5 | — | — | — |
| Rosin | 0.3 | 0.3 | 0.3 | 0.3 |
| Sodium chloride | 11.2 | — | — | — |
| Cirrasol TW | 0.3 | 0.3 | 0.3 | 0.3 |

Three sets of compositions have been presented in the above tables. The first set (Table-1) deals with the compositions of Nitroglycerine based gelatine explosives where only a small amount of dispersing agent was used to bring down the Nitric esters and BSNC content. The compositions cited in this set are for the purpose of examples and are not limited to those only. The second set (Table-3) deals with the compositions of Nitroglycerine based gelatine explosives where no dispersing agents were used. The third set (Table-5) deals with the compositions of Nitroglycerine based gelatine explosives where plasticity promoting agent and wheat flour were used to bring down the Nitroglycerine content. Sets second and third are not part of the invention and have been included in the Tables only to serve as illustrations to substantiate the superiority of the examples of the first set i.e., the compositions according to the invention. Simultaneously, along with the composition tables, the other important explosive properties of the three sets of compositions have been illustrated for purposes of comparison and to establish the superior performance of the compositions according to the invention. Table 7 shows the compositions containing Tamarind Seed Flour and dispersing agent.

We claim:

1. In a gelatin explosive composition with a marked reduction in the quantities of liquid nitric esters and blasting soluble nitrocotton content, comprising mixtures of liquid nitric esters, blasting soluble nitrocotton, oxidizing salts and fuels, the improved gelatin explosive composition containing at least one dispersing agent.

2. A gelatine explosive composition as claimed in claim 1 containing in addition a water proofing agent.

3. A gelatine explosive composition as claimed in claim 1 wherein the dispersing agent is present in an amount 0.10 to 1.0% w/w.

4. A gelatine explosive composition as claimed in claim 3, wherein the dispersing agent is present in an amount 0.10 to 0.4% w/w.

5. A gelatine explosive composition as claimed in claim 2, wherein the water proofing agent used is or guar gum tamarind seed flour.

6. A gelatine explosive composition as claimed in claim 5, wherein the tamarind seed flour is present in an amount of up to 3.0% w/w to further reduce the content of nitric esters and blasting soluble nitrocotton in the composition.

7. A gelatine explosive composition as claimed in claim 1 wherein the dispersing agent used is an amide of fatty acid.

8. A gelatine explosive composition as claimed in claim 1, wherein the dispersing agent used is a condensation product of formaldehyde and sodium naphthalene sulphonate.

9. A gelatine explosive composition as claimed in claim 1, wherein the dispersing agent used is a sodium salt of sulphated oleyl/cetyl alcohol mixture.

10. A gelatine explosive composition as claimed in claim 1, wherein the dispersing agent used is a condensation product of polytheylene glycol.

11. A gelatine explosive composition as claimed in claim 1, wherein the dispersing agent used is a highly sulphated methyl ester of fatty alcohol.

12. A gelatine explosive composition as claimed in claim 1, wherein the dispersing agent used is a mixture of fatty acid amine and sulphated alcohol.

13. A gelatine explosive composition as claimed in claim 1, wherein the dispersing agent used is an alkyl aryl sulphonated sodium salt.

14. A gelatine explosive composition as claimed in claim 1, wherein the dispersing agent used is soya oil fatty amine.

15. A gelatine explosive composition as claimed in claim 1, wherein the dispersing agent used is triethanol amine fatty acid.

16. A gelatine explosive composition as claimed in claim 1, wherein the dispersing agent used is monoethylene glycol.

* * * * *